US009546078B2

(12) United States Patent
Paasisalo

(10) Patent No.: US 9,546,078 B2
(45) Date of Patent: Jan. 17, 2017

(54) PIVOTING ARRANGEMENT, ROOF ELEMENT AND ELEVATOR

(71) Applicant: KONE Corporation, Helsinki (FI)

(72) Inventor: Jussi Paasisalo, Riihimäki (FI)

(73) Assignee: KONE CORPORATION, Helsinki (FI)

( * ) Notice: Subject to any disclaimer, the term of this patent is extended or adjusted under 35 U.S.C. 154(b) by 308 days.

(21) Appl. No.: 14/265,060

(22) Filed: Apr. 29, 2014

(65) Prior Publication Data

US 2014/0231182 A1 Aug. 21, 2014

Related U.S. Application Data

(63) Continuation of application No. PCT/FI2012/051089, filed on Nov. 7, 2012.

(30) Foreign Application Priority Data

Nov. 7, 2011 (FI) ..... 20116096

(51) Int. Cl.
*B66B 13/24* (2006.01)
*B66B 11/02* (2006.01)

(52) U.S. Cl.
CPC ..... *B66B 13/24* (2013.01); *B66B 11/0226* (2013.01)

(58) Field of Classification Search
CPC ... B66B 13/24; B66B 11/0226; B66B 11/0246
USPC ..... 187/401
See application file for complete search history.

(56) References Cited

U.S. PATENT DOCUMENTS 6,202,800 B1 * 3/2001 Muller ..... B66B 11/0246 187/401
6,202,801 B1 * 3/2001 Muller ..... B66B 11/0246 187/269
6,209,686 B1 * 4/2001 Tomasetti ..... B66B 11/0206 187/401
6,419,052 B1 * 7/2002 Muller ..... B66B 11/0246 187/414
6,691,833 B1 * 2/2004 Elsener ..... B66B 11/0246 187/254
6,880,678 B1 * 4/2005 Schneider ..... B66B 11/0246 187/314

(Continued)

FOREIGN PATENT DOCUMENTS

DE 200 19 236 U1 5/2001
DE 199 62 521 A1 7/2001

(Continued)

*Primary Examiner* — William A Rivera
(74) *Attorney, Agent, or Firm* — Birch, Stewart, Kolasch & Birch, LLP

(57) ABSTRACT

Pivoting arrangement of an emergency exit hatch of an elevator, the arrangement being for a surrounding frame structure, a roof element of an elevator, and an elevator, in which arrangement the emergency exit hatch of the elevator is a planar element, and includes pivot brackets on its opposite sides, and the frame structure includes an aperture, which the hatch is arranged to cover, and which aperture includes pivot apertures in its opposite sides, for receiving the pivot brackets, and the planar hatch element and/or the frame structure is/are fabricated from plate material, and the part of the frame structure including a pivot aperture and/or the part of the hatch including a pivot bracket is/are of the plate material.

12 Claims, 5 Drawing Sheets

(56) References Cited

U.S. PATENT DOCUMENTS

Figure 1A:
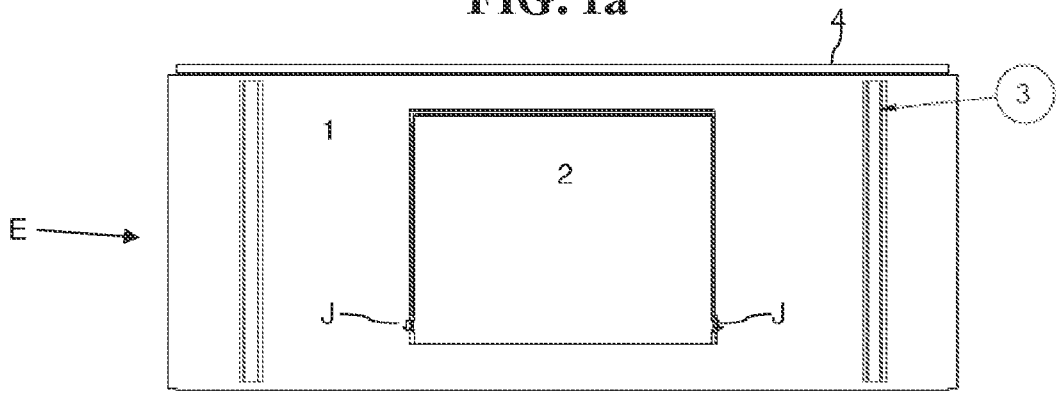

| | | | | |
|---|---|---|---|---|
| 7,337,880 | B2 * | 3/2008 | Sittler | B66B 11/0246 187/254 |
| 7,523,809 | B2 * | 4/2009 | Monzon-Simon | B66B 5/0056 182/148 |
| 8,316,998 | B2 * | 11/2012 | Henseler | B66B 11/0246 187/317 |
| 9,193,566 | B1 * | 11/2015 | Nieves | B66B 11/0226 |
| 2003/0015378 | A1 * | 1/2003 | Elsener | B66B 11/0246 187/336 |
| 2006/0285364 | A1 | 12/2006 | Cok | |

FOREIGN PATENT DOCUMENTS

| | | | |
|---|---|---|---|
| DE | 20 2007 001 840 | U1 | 5/2007 |
| EP | 0 448 846 | A1 | 10/1991 |
| GB | 2 116 601 | A | 9/1983 |
| GB | 2 456 646 | A | 7/2009 |

* cited by examiner

PIVOTING ARRANGEMENT, ROOF ELEMENT AND ELEVATOR

FIELD OF THE INVENTION

The object of the invention is a pivoting arrangement, a roof element, and an elevator, more particularly a pivoting arrangement of an emergency exit hatch of an elevator for a roof element in an elevator applicable to the transporting of people and/or of freight.

BACKGROUND OF THE INVENTION

Elevator cars are conventionally formed to comprise a load-bearing frame structure, i.e. a car sling, which comprises a lower horizontal beam system and an upper horizontal beam system, as well as a vertical beam system of a first side and a vertical beam system of a second side, which beam systems are connected to each other so that they form a closed ring, inside which is an interior comprised in a car box fixed to the beam systems, which interior can receive goods and/or passengers for conveying them in the interior of the elevator car.

The elevator car of the elevator can also be fitted inside a car sling composed of a top element, a bottom element and also side elements, i.e. vertical elements. The car and car sling can if necessary also be integrated into each other.

The outer surface of the roof of an elevator car is generally formed from plates that are firmly and rigidly supported on the upper horizontal beam system. According to prior art, there is a separate roof panel in elevator cars, below the upper horizontal beam system and the aforementioned plates forming the outer surface.

According to national and international regulations, connected to the structure of the outer surface of the roof of the elevator car is an emergency exit hatch, which is often hinged with fixed hinges to the roof structure. A roof structure of an elevator with an emergency exit hatch provided with fixed hinges is awkward and expensive to manufacture and separate fixing means are needed for installing the roof hatch as well as special tools for fixing the hinges. In addition, separate locking means are needed for locking the emergency exit hatch, which again increases the amount of parts needed and thereby the manufacturing costs, installation costs and servicing costs of the product.

Installing fixed hinges in the emergency exit hatch also essentially limits the opening direction of the hatch. Retrospectively changing the opening direction of an emergency exit hatch provided with fixed hinges is awkward and expensive, requires that the fitter has many special tools, and in some cases might even be impossible owing to the roof structure of the elevator.

Generally speaking, one problem, among others, with solutions according to prior art, such as e.g. the solution presented in publication GB2116601A, can be considered to be the non-optimal construction. More particularly the roof structure of the elevator car has not been optimized as an entity sufficiently from the standpoint of space usage and of the complexity of the construction. All the essential factors have not been simultaneously taken into account to an adequate extent, more particularly the number of parts of the roof structure of an elevator, and the techniques for manufacturing them, have not been optimal. Simplification of the roof structure and a reduction in the number of parts therefore directly impacts manufacturing costs, installation costs and servicing costs, and also increases the reliability of the elevator and reduces the structural weight of the elevator thereby lowering energy consumption and reducing operating costs. Each gram by which the structural weight, and thus the energy consumption, of the elevator can be reduced is important.

AIM OF THE INVENTION

The aim of the invention is to eliminate, inter alia, the aforementioned drawbacks of prior-art solutions. More particularly the aim of the invention is to produce a roof element of an elevator, and an elevator, the roof structure of the elevator car of which comprises a roof element comprising an emergency exit hatch designed with a simple construction. The aim of the invention is further to produce one or more of the following advantages, among others:

- A roof element of an elevator and an elevator are achieved, in which the roof element of the elevator is of simple construction and has a lower total weight than earlier.
- A roof element of an elevator and an elevator are achieved, in which the roof element of the elevator is easier and cheaper to install than earlier.
- A roof element of an elevator and an elevator are achieved, in which the manufacturing costs of the roof element of the elevator are lower than earlier.
- A roof element of an elevator and an elevator are achieved, in which the roof element of the elevator comprises an emergency exit hatch, having a pivoting arrangement that is simpler than earlier, and for the installation of which pivoting arrangement special tools are not needed.
- A roof element of an elevator and an elevator are achieved, in which the roof element of the elevator comprises an emergency exit hatch, which when it opens does not require a separate limiter for preventing the hatch from opening completely, limitation is implemented by the aid of the pivoting arrangement.
- A roof element of an elevator and an elevator are achieved, in which the roof element of the elevator comprises an emergency exit hatch, the locking of which is simple, and the opening direction of which in the elevator is possible inwards and/or outwards without a separate change in the roof structure.

SUMMARY OF THE INVENTION

The pivoting arrangement of an emergency exit hatch of an elevator according to the invention is characterized by what is disclosed in the claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

According to the invention the frame structure around the pivoting arrangement of the emergency exit hatch of an elevator comprises the frame structure and a hatch, in which arrangement the aforementioned hatch is a planar element, and comprises pivot brackets on its opposite sides, which pivot brackets are rigidly supported on the hatch element, and the aforementioned frame structure comprises an aperture, which the aforementioned hatch is arranged to cover, and which aperture comprises pivot apertures in its opposite sides, for receiving the aforementioned pivot brackets, and which pivot apertures comprise different positions for a pivot bracket, and the aforementioned planar hatch element and/or the aforementioned frame structure is/are fabricated from plate material, the part of the frame structure comprising a pivot aperture and/or the part of the hatch comprising a pivot bracket is/are of the aforementioned plate material.

The invention is based on the concept that the roof structure of an elevator car of an elevator comprises a separate roof element, which roof element comprises an emergency exit hatch operating on a new type of operating principle, wherein the pivoting of the aforementioned hatch in a surrounding frame structure enables a new type of pivoting arrangement for the hatch.

In one basic embodiment of the concept according to the invention the roof element comprises a frame structure and an emergency exit hatch, in which roof element the pivoting of the aforementioned hatch in the surrounding frame structure is arranged by the aid of pivot brackets disposed on opposite sides on the aforementioned hatch, and pivot apertures disposed on opposite sides in the aforementioned frame structure, for receiving the pivot brackets of the hatch. Locking to the frame is implemented in a way in which separate locking means for locking and opening the hatch are not needed. The aforementioned pivot aperture comprises an elongated section in the direction of the plane, resting on the edge of which section the pivot bracket can be configured to be supported.

In one basic embodiment of the concept according to the invention the emergency exit hatch is arranged to fold in relation to the frame structure such that the pivot brackets in the pivot aperture apertures form an axis of rotation in the direction of the plane for the pivot arrangement. The pivot aperture opens in an orthogonal direction to the axis of rotation, and the pivot brackets are arranged in the direction of the axis of rotation into the pivot apertures in opposite directions. The pivot brackets fit to move in the pivot apertures in the direction of the pivot aperture such that the pivot aperture comprises different positions for the pivot brackets.

In one embodiment of the invention one or more stiffeners and/or reinforcements are added to the frame structure of the roof element and/or to the aforementioned hatch, which stiffener and/or reinforcement is glued, riveted or welded to the frame structure and/or to the aforementioned hatch.

In one embodiment of the invention opening of the locking of the emergency exit hatch of the elevator is only possible from the roof of the elevator. Changing the opening side of the locking of the aforementioned hatch to the inside of the elevator is possible. In addition, the locking of the aforementioned hatch can be made to be openable from both sides.

In one embodiment of the invention the locking of the emergency exit hatch of the elevator is arranged with the already existing locks/locking systems. Preferably the locking of the emergency exit hatch is handled with a lock package, which is used with a triangle key.

In one embodiment of the invention electrical circuit-breakers of the safety circuit and the necessary locking elements, such as e.g. pins, are added to the roof element of the elevator for locking the aforementioned hatch to the frame.

Preferably the roof element of the elevator forms a part of the inside wall of the roof structure of the elevator, in which roof element an emergency exit hatch is disposed.

Preferably the roof element of the elevator forms a part of the outside wall of the roof structure of the elevator, in which roof element an emergency exit hatch is disposed.

In one basic embodiment of the invention the elevator comprises an elevator hoistway, and an elevator car arranged to move in the elevator hoistway.

The elevator is most preferably an elevator applicable to the transporting of people and/or of freight, which elevator is installed in a building, to travel in a vertical, or at least essentially vertical, direction, preferably on the basis of landing calls and/or car calls. The aforementioned interior is most preferably suited to receive a passenger or a number of passengers. The elevator preferably comprises at least two, preferably more, floors to be served.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

LIST OF FIGURES

In the following, the invention will be described in detail by the aid of some embodiments with reference to the attached drawings, wherein FIG. 1*a* presents a bottom view of a roof element of an elevator according to the invention.

Figure 1B:
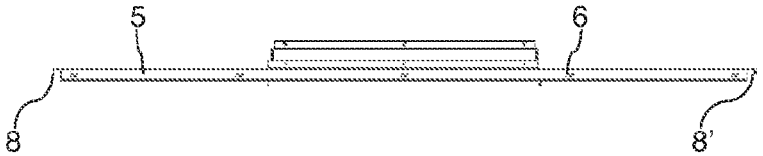

FIG. 1*b* presents a side view from the front of the roof element of an elevator according to FIG. 1*a*.

Figure 1C:
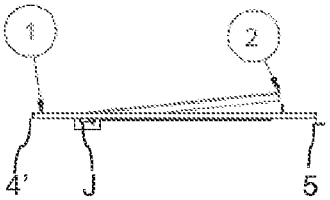

FIG. 1*c* presents a side view from the left of the roof element of an elevator according to FIG. 1*a*.

Figure 1D:
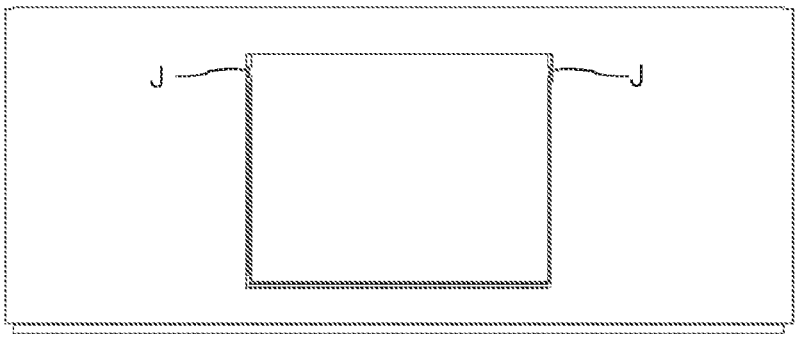

FIG. 1*d* presents a top view of the roof element of an elevator according to FIG. 1*a*.

Figure 1E:
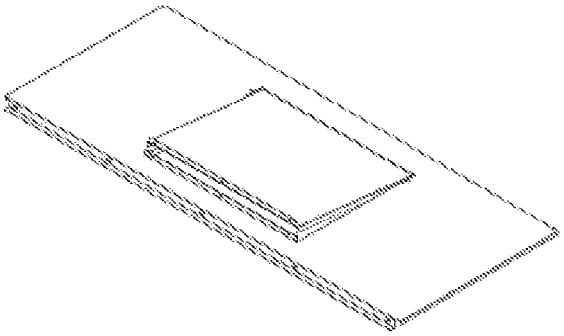

FIG. 1*e* presents a three-dimensional oblique top view of the roof element of an elevator according to FIG. 1*a*.

Figure 2A:
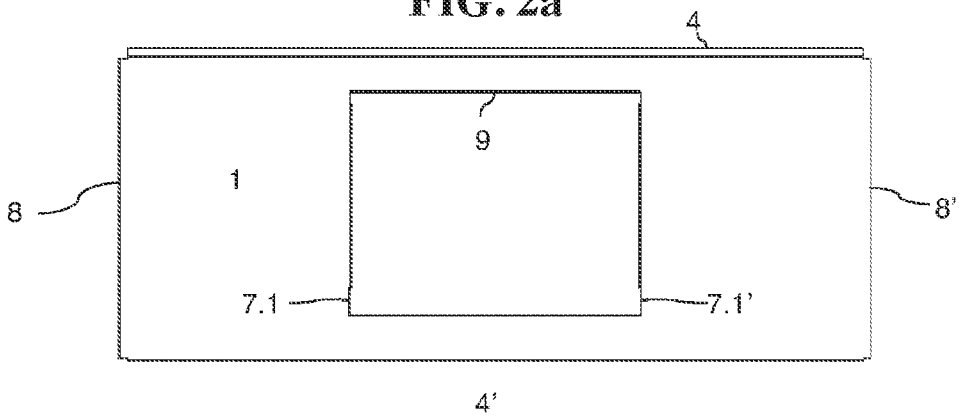

FIG. 2*a* presents a bottom view of a frame structure of a roof element of an elevator according to the invention.

Figure 2B:
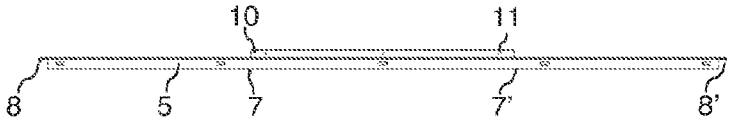

FIG. 2*b* presents a side view from the front of a frame structure of the roof element of an elevator according to FIG. 2*a*.

Figure 2C:
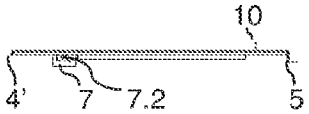

FIG. 2*c* presents a side view from the left of a frame structure of the roof element of an elevator according to FIG. 2*a*.

Figure 2D:
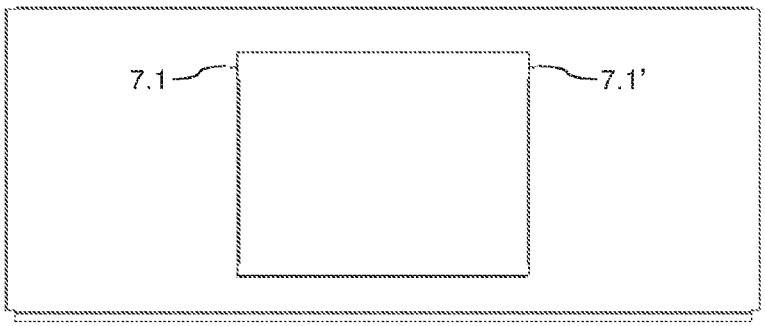

FIG. 2*d* presents a top view of a frame structure of the roof element of an elevator according to FIG. 2*a*.

Figure 2E:
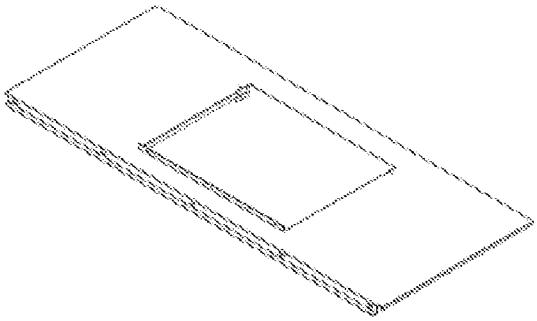

FIG. 2*e* presents a three-dimensional oblique top view of a frame structure of the roof element of an elevator according to FIG. 2*a*.

Figure 3A:
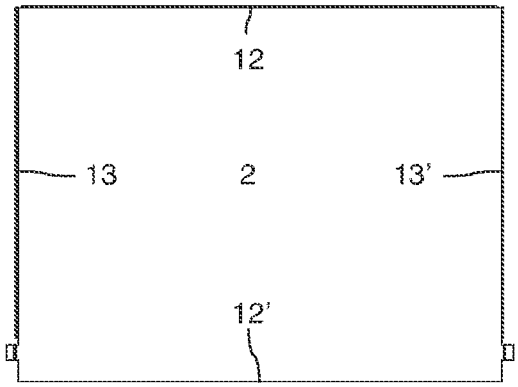

FIG. 3*a* presents a bottom view of an emergency exit hatch of a roof element of an elevator according to the invention.

Figure 3B:
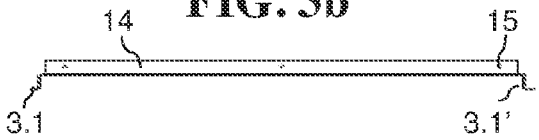

FIG. 3*b* presents a side view from the front of an emergency exit hatch of the roof element of an elevator according to FIG. 3*a*.

Figure 3C:
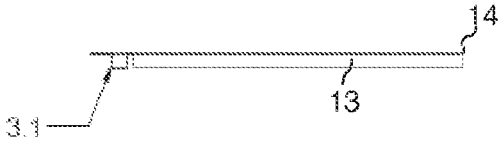

FIG. 3*c* presents a side view from the left of an emergency exit hatch of the roof element of an elevator according to FIG. 3*a*.

Figure 3D:
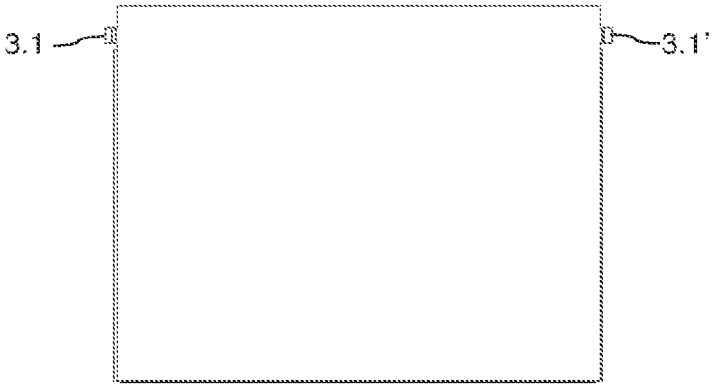

FIG. 3*d* presents a top view of an emergency exit hatch of the roof element of an elevator according to FIG. 3*a*.

Figure 3E:
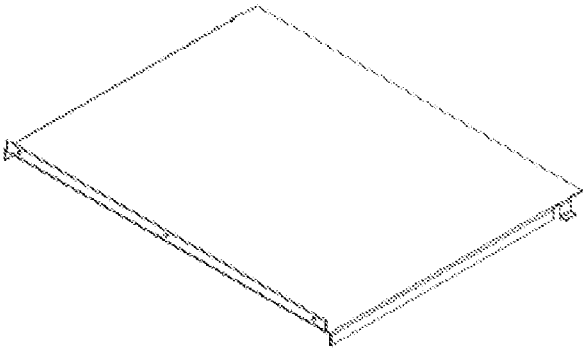

FIG. 3*e* presents a three-dimensional oblique top view of an emergency exit hatch of the roof element of an elevator according to FIG. 3*a*.

Figure 4:
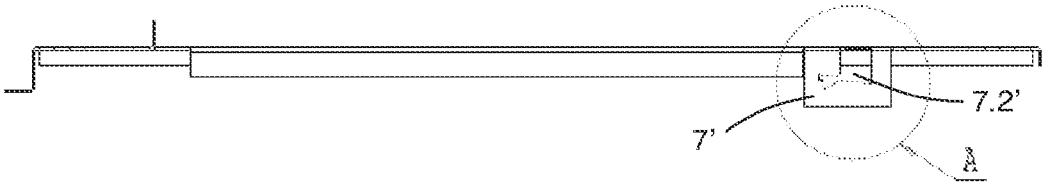

FIG. 4 presents a pivot arrangement of an emergency exit hatch of a roof element of an elevator according to the invention, as viewed from the side and right of the frame structure.

Figure 5:
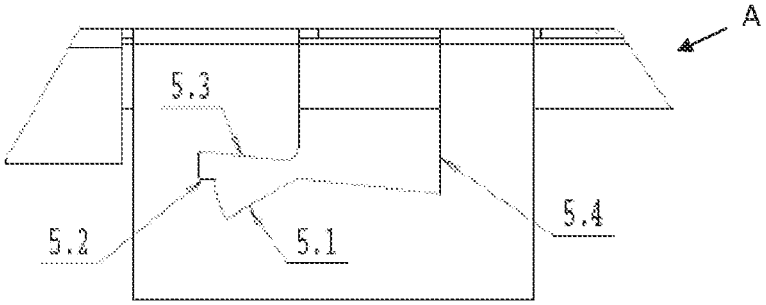

FIG. 5 presents a side view from the right of the edge of a pivot aperture of a pivot arrangement of an emergency exit hatch of the roof element of an elevator according to FIG. 4.

Figure 6:
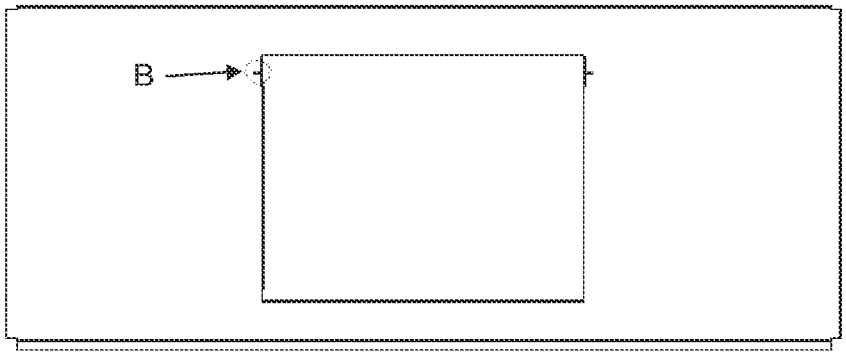

FIG. 6 presents the grooves of the pivot apertures of a pivot arrangement of an emergency exit hatch of a roof element of an elevator according to the invention, as viewed from above the frame structure.

Figure 7:
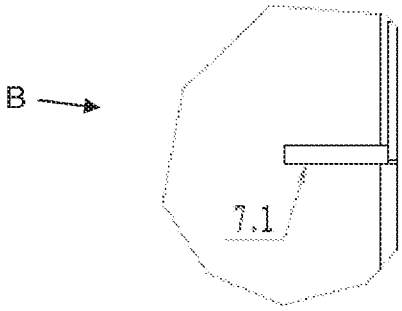

FIG. 7 presents a magnified view of the groove of the left-hand pivot aperture of the pivot arrangement of an emergency exit hatch of the roof element of an elevator according to FIG. 6, as viewed from above the frame structure.

Figure 8:
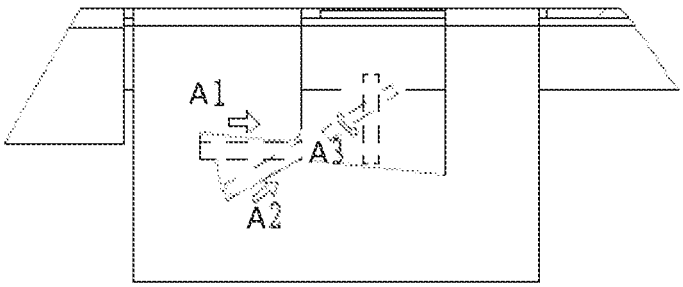

FIG. 8 presents the positions in the pivot aperture of the pivot bracket of an emergency exit hatch of the roof element of an elevator according to FIG. 5, when the hatch is opening inwards into the elevator.

Figure 9:
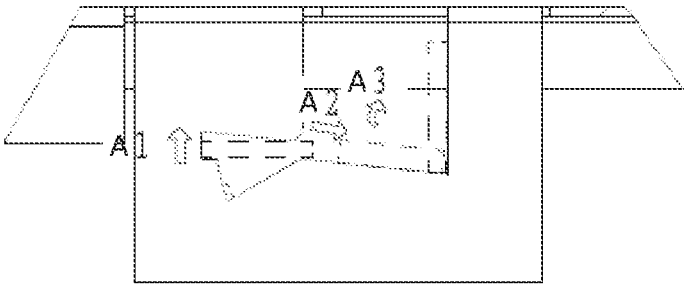

FIG. 9 presents the positions in the pivot aperture of the pivot bracket of an emergency exit hatch of the roof element of an elevator according to FIG. 5, when the hatch is opening outwards from the elevator.

DETAILED DESCRIPTION OF THE INVENTION

FIG. 1*a* presents one embodiment of a roof element E of an elevator according to the invention as viewed from below. The roof element E comprises a frame structure 1, an emergency exit hatch 2 and a reinforcement 3 connected to the frame structure. The frame structure 1 of the roof element is a planar element of rectangular shape. The term planar element means a structure having at least essentially opposite surfaces, which can be formed from one or more parts and can comprise apertures, machinings, bendings. The front edge 4 of the frame structure 1 has a fixing flange 5, below the plane of the frame structure, essentially orthogonal to the plane, bent into an L-shape for fixing the roof element to the roof structure of the elevator. The opposite sides in the frame structure 1 of the roof element E have grooves 7.1, 7.1' belonging to the pivot arrangement of the hatch 2 of the roof element for situating the pivot brackets 3.1, 3.1' of the aforementioned hatch in the pivot apertures 7.2, 7.2' of the frame structure.

FIG. 1*b* presents an embodiment of a roof element E of an elevator according to FIG. 1*a*, as viewed from the side and front. One or more apertures 6, for the through-holes of fixing elements, such as e.g. screws, are disposed on the side of the fixing flange 5 bent essentially orthogonally to the plane of the fixing flange 5. The opposite sides 8, 8' of the frame structure 1 of the roof element E are bent, essentially orthogonally to the plane, to below the plane of the frame structure.

FIG. 1*c* presents a side view from the left of one embodiment of a roof element E of an elevator according to FIG. 1*a*. The rear edge 4' opposite the front edge 4 of the frame structure 1 of the roof element E is bent, essentially orthogonally to the plane, preferably to below the plane of the frame structure. The frame structure 1 of the roof element E comprises a fold 7 belonging to the pivot arrangement of the hatch of the roof element, which fold comprises a pivot aperture, for receiving the pivot bracket 3.1 of the aforementioned hatch 2.

FIG. 1*d* presents a top view of an embodiment of a roof element E of an elevator according to FIG. 1*a*. On opposite sides on the frame structure 1 of the roof element E are grooves 7.1, 7.1' belonging to the pivot arrangement of the hatch 2 of the roof element for situating the pivot brackets 3.1, 3.1' of the hatch in the pivot apertures 7.2, 7.2' of the frame structure.

FIG. 1*e* presents a three-dimensional oblique top view of an embodiment of a roof element E of an elevator according to FIG. 1*a*, when the hatch 2 is opened upwards.

FIG. 2*a* presents one embodiment of a frame structure 1 of a roof element E of an elevator according to the invention as viewed from below. The frame structure 1 of the roof element E comprises a front edge 4, opposite sides 8, 8', a rear edge 4' and an aperture, which is open orthogonally to the plane, essentially rectangular in shape, and which the aforementioned hatch is arranged to cover. On the front edge 9 of the aperture is an edge flange 10 of the aperture, which edge flange 10 is bent, essentially orthogonally to the plane, preferably to above the plane. On the sides of the aperture, which sides are on the plane essentially orthogonal to the front edge 9 of the aperture, are bendings, preferably to below the plane. On the opposite sides of the aforementioned aperture, preferably in the proximity of the rear edge, are grooves 7.1, 7.1' belonging to the pivot arrangement of the hatch 2 for situating the pivot brackets 3.1, 3.1' of the aforementioned hatch 2 in the pivot apertures 7.2, 7.2' of the frame structure. The height of the bent edges of the frame structure and of the pivot brackets is preferably at most 100 mm, more preferably at most 50 mm, most preferably approx. 5-40 mm.

FIG. 2*b* presents an embodiment of a frame structure 1 of a roof element E of an elevator according to FIG. 2*a*, as viewed from the side and front. The edge flange 10 of the front edge 9 of the aforementioned aperture of the frame structure 1 comprises one or more apertures 11 for the fixing of a locking element, such as e.g. a locking pin, for locking the hatch 2 to the frame structure.

FIG. 2*c* presents an embodiment of a frame structure 1 of a roof element E of an elevator according to FIG. 2*a* as viewed from the side and left. The opposite sides 8, 8' and the rear edge 4' of the frame structure 1 of the roof element E comprise edges bent, essentially orthogonally to the plane, preferably to below the plane of the frame structure. The frame structure 1 of the roof element E comprises a fold 7, with pivot aperture 7.2, belonging to the pivot arrangement of the emergency exit hatch of the roof element, for receiving the pivot bracket 3.1 of the aforementioned hatch 2.

FIG. 2*d* presents an embodiment of a frame structure 1 of a roof element E of an elevator according to FIG. 2*a* as viewed from above.

FIG. 2*e* presents a three-dimensional oblique top view an embodiment of a frame structure 1 of a roof element E of an elevator according to FIG. 2*a*.

FIG. 3*a* presents an embodiment of an emergency exit hatch 2 of a roof element E of an elevator according to FIG. 3*a*, as viewed from below. The aforementioned hatch 2 of the roof element E is an essentially rectangular planar element, which comprises a front edge 12, a rear edge 12', opposite sides 13, 13' and pivot brackets 3.1, 3.1' on opposite sides of the aforementioned hatch 2. On the front edge 12 of the hatch 2 is an edge flange 14, which edge flange 14 is bent, essentially orthogonally to the plane, preferably to above the plane. On opposite sides 13, 13' of the hatch 2, which sides 13, 13' are on the plane essentially orthogonal to the front edge 12 of the hatch, are folds, preferably to below the plane. On the opposite sides of the aforementioned aperture, preferably in the proximity of the rear edge, the pivot brackets 3.1, 3.1' of the aforementioned hatch are arranged, for situating in the pivot apertures 7.2, 7.2' of the frame structure. The width and/or height of the bent edges of the hatch and of the pivot brackets are preferably at most 100 mm, more preferably at most 50 mm, most preferably approx. 5-40 mm.

FIG. 3*b* presents an embodiment of an emergency exit hatch 2 of a roof element E of an elevator according to FIG. 3*a*, as viewed from the side and front. In the locking flange 14 of the front edge 12 of the hatch 2 are one or more apertures 15 for a locking element, such as e.g. for a locking pin, for locking the aforementioned hatch 2 to the frame structure 1. On the opposite sides of the hatch, preferably in the proximity of the rear edge, are pivot brackets 3.1, 3.1' of the pivot arrangement of the emergency exit hatch 2 of the roof element, said brackets being bent into an L-shaped profile, for situating in the pivot apertures 7.2, 7.2' of the frame structure 1.

FIG. 3*c* presents a side view from the left of an embodiment of an emergency exit hatch 2 of a roof element E of an elevator according to FIG. 3*a*. In the proximity of the rear edge 12' of the hatch 2 is a pivot bracket 3.1 of the pivot arrangement of the emergency exit hatch for situating in the pivot aperture 7.2 of the frame structure 1. The side edge 13 of the aforementioned hatch 2 is bent, essentially orthogonally to the plane of the hatch 2, preferably downwards. The front edge 14 of the aforementioned hatch 2 is bent, essentially orthogonally to the plane of the hatch 2, preferably upwards.

FIG. 3*d* presents an embodiment of an emergency exit hatch 2 of a roof element E of an elevator according to FIG. 3*a* as viewed from above.

FIG. 3*e* presents a three-dimensional oblique top view an embodiment of an emergency exit hatch 2 of a roof element E of an elevator according to FIG. 3*a*.

FIG. 4 presents a pivot arrangement of an emergency exit hatch according to one embodiment of a roof element E of an elevator according to the invention, as viewed from the side and right of the frame structure 1.

FIG. 5 presents a magnification A of a pivot aperture 7.2' of a fold 7' of a frame structure 1 of a pivot arrangement of an emergency exit hatch according to one embodiment of a roof element E of an elevator according to FIG. 4, as viewed from the side and right. The fold 7, 7' is essentially orthogonal to the plane of the frame structure 1 and comprises a pivot aperture 7.2, 7.2', which pivot aperture 7.2, 7.2' comprises

- a part 5.1 of the edge of the pivot aperture limiting the magnitude of the opening of the aforementioned hatch 2 towards inside the elevator,
- a part 5.2 of the edge of the pivot aperture limiting the state of the initial position of the aforementioned hatch 2, when the hatch is closed,
- a part 5.3 of the edge of the pivot aperture enabling opening of the aforementioned hatch 2 outwards from the car of the elevator, in which case the aforementioned hatch is able to descend at its rear edge to below the edge of the frame, and
- a part 5.4 of the edge of the pivot aperture limiting the rearward movement of the aforementioned hatch 2, which enables turning of the pivot brackets 3.1, 3.1' of the hatch 2 from the horizontal into a vertical position.

FIG. 6 presents a top view of a groove of a frame structure of a pivot arrangement of an emergency exit hatch according to an embodiment of the roof element E of an elevator according to FIG. 5. On the opposite sides of the aperture of the aforementioned frame structure 1, which aperture the hatch is arranged to cover, at the point of the pivot brackets, on the plane of the frame structure, are arranged rectangular grooves 7.1, 7.1' through the frame structure, for situating the pivot brackets 3.1, 3.1' of the aforementioned hatch 2 in the pivot apertures.

FIG. 7 presents a magnification B of a groove of a frame structure of a pivot arrangement according to an embodiment of a roof element E of an elevator according to FIG. 6, as viewed from the top.

FIG. 8 presents the positions in the pivot aperture of the pivot bracket of the emergency exit hatch of a roof element E of an elevator according to the invention, when the aforementioned hatch is opening inwards into the elevator. The pivot bracket can be fitted into the pivot aperture in a first, second and third position. From the first position A1 the hatch 2 is pushed slightly rearwards so that the pivot bracket 3.1 of the hatch 2 settles into the position A2, in the point 5.1 of the pivot aperture. The hatch 2 is pushed rearwards, and the pivot bracket 3.1 settles into the position A3 in the pivot aperture, in which case the hatch 2 can be feely turned inwards into the elevator.

FIG. 9 presents the positions in the pivot aperture of the pivot bracket of the emergency exit hatch of a roof element E of an elevator according to the invention, when the aforementioned hatch is opening outwards from the elevator. The pivot bracket can be fitted into the pivot aperture in a first, second and third position. In the first position A1 the hatch 2 is raised slightly so that the pivot bracket 3.1 settles against the point 5.3 of the pivot aperture. The hatch 2 is pushed rearwards, and the pivot bracket displaces into the position A2 of the pivot aperture, against the point 5.4 of the pivot aperture. In position A3 the hatch 2 can be freely turned outwards from the elevator.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. An elevator roof structure comprising:

a frame structure comprising:
- a frame front edge;
- a frame rear edge;
- a frame first side edge;
- a frame second side edge, and
- an aperture, the aperture comprises:
  - an aperture front edge;
  - an aperture rear edge;
  - an aperture first side edge;
  - an aperture second side edge; and
  - at least one pivot aperture, wherein the at least one pivot aperture is located at one of the aperture first side edge and the aperture second side edge;

a hatch having a planar surface, the hatch comprising:
- a hatch front edge;
- a hatch rear edge;
- a hatch first side edge;
- a hatch second side edge; and at least one pivot bracket, wherein the at least one pivot is located at one of the hatch first side edge and the hatch second side edge, wherein the at least one pivot aperture is configured to receive the at least one pivot bracket, and wherein the pivot aperture further comprises:

a pivot aperture first part configured to limit the magnitude of the opening of said hatch;

a pivot aperture second part configured to limit the initial position of the hatch when the hatch is closed;

a pivot aperture third part configured to enable the opening of the hatch outwards from an elevator car; and a pivot aperture fourth part configured to enable turning of the hatch from a horizontal position to a vertical position.

2. The elevator roof structure of claim 1, wherein the frame structure further comprises a reinforcement extending substantially from the frame front edge to the frame rear edge.

3. The elevator roof structure of claim 1, wherein the frame structure and the hatch have a uniform thickness.

4. The elevator roof structure of claim 1, wherein the frame structure further comprises at least one locking aperture, wherein a locking element is provided in the at least one locking aperture and is configured to lock the hatch.

5. The elevator roof structure of claim 1, wherein the hatch is configured to open towards an elevator car interior and away from the elevator car interior.

6. The elevator roof structure of claim 1, wherein the hatch front edge comprises a hatch front edge flange, wherein the hatch front edge flange extends above the frame.

7. The elevator roof structure of claim 6, wherein the hatch first side edge comprises a hatch first side edge flange extending below the frame, and wherein the hatch second side edge comprises a hatch second side edge flange extending below the frame.

8. The elevator roof structure of claim 7, wherein the hatch first side edge and the hatch second side edge further comprise said at least one pivot bracket.

9. The elevator roof structure of claim 1, wherein the hatch first side edge comprises a hatch first side edge flange extending below the frame, and wherein the hatch second side edge comprises a hatch second side edge flange extending below the frame.

10. The elevator roof structure of claim 1, wherein the frame further comprises a frame fixing flange, and wherein said frame fixing flange extends below the frame.

11. The elevator roof structure of claim 1, wherein said at least one pivot aperture comprises a bent portion of the frame extending transverse to a top surface and a bottom surface of the frame.

12. An elevator comprising an elevator car having the elevator roof structure of claim 1.

* * * * *